US005170598A

United States Patent [19]

Kadar et al.

[11] Patent Number: 5,170,598

[45] Date of Patent: Dec. 15, 1992

[54] TRIANGULAR COMPOSITE EXOSKELETON STRUCTURE

[75] Inventors: Istvan Kadar, Terra Linda; John H. Robinson, Danville, both of Calif.

[73] Assignee: Bechtel Energy Corporation, San Francisco, Calif.

[21] Appl. No.: 505,794

[22] Filed: Apr. 6, 1990

[51] Int. Cl.[5] ..... E04B 1/32

[52] U.S. Cl. ..... 52/80; 52/245; 261/DIG. 11; 403/347

[58] Field of Search ..... 52/80, 81, 86, 245; 261/DIG. 11; 403/347, 346, 207

[56] References Cited

U.S. PATENT DOCUMENTS

| | | | |
|---|---|---|---|
| 3,197,927 | 8/1965 | Fuller | 52/81 |
| 3,300,942 | 1/1967 | Horstman | 52/80 |
| 3,844,074 | 10/1974 | Ahern | 52/81 |
| 4,077,174 | 3/1978 | Léaumont | 52/245 |
| 4,091,583 | 5/1978 | Genis | 52/81 |
| 4,092,811 | 6/1978 | Lin | 52/80 |

FOREIGN PATENT DOCUMENTS

| | | | |
|---|---|---|---|
| 592948 | 2/1978 | U.S.S.R. | 52/245 |

*Primary Examiner*—Henry E. Raduazo
*Attorney, Agent, or Firm*—Townsend and Townsend

[57] ABSTRACT

An exoskeleton structure made up of a plurality of pairs of triangular units which are adjacent to each other and which are interconnected. Each triangular unit has a generally horizontal segment and a pair of upright diagonal segments connected to the respective ends of the respective horizontal segment. The segments of each structural unit are shell-like or transversely curved so that, when they mate with the segments of adjacent triangular units, the segments of the two units form frame elements having hollow interior spaces for receiving concrete which is directed into the hollow spaces after the structural units have been erected. The configuration of adjacent structural units is repeated throughout the entire extent of the structure so that the numerous triangular structural units form an exoskeleton structure having maximum strength and high resistance to lateral forces.

17 Claims, 7 Drawing Sheets

FIG.4
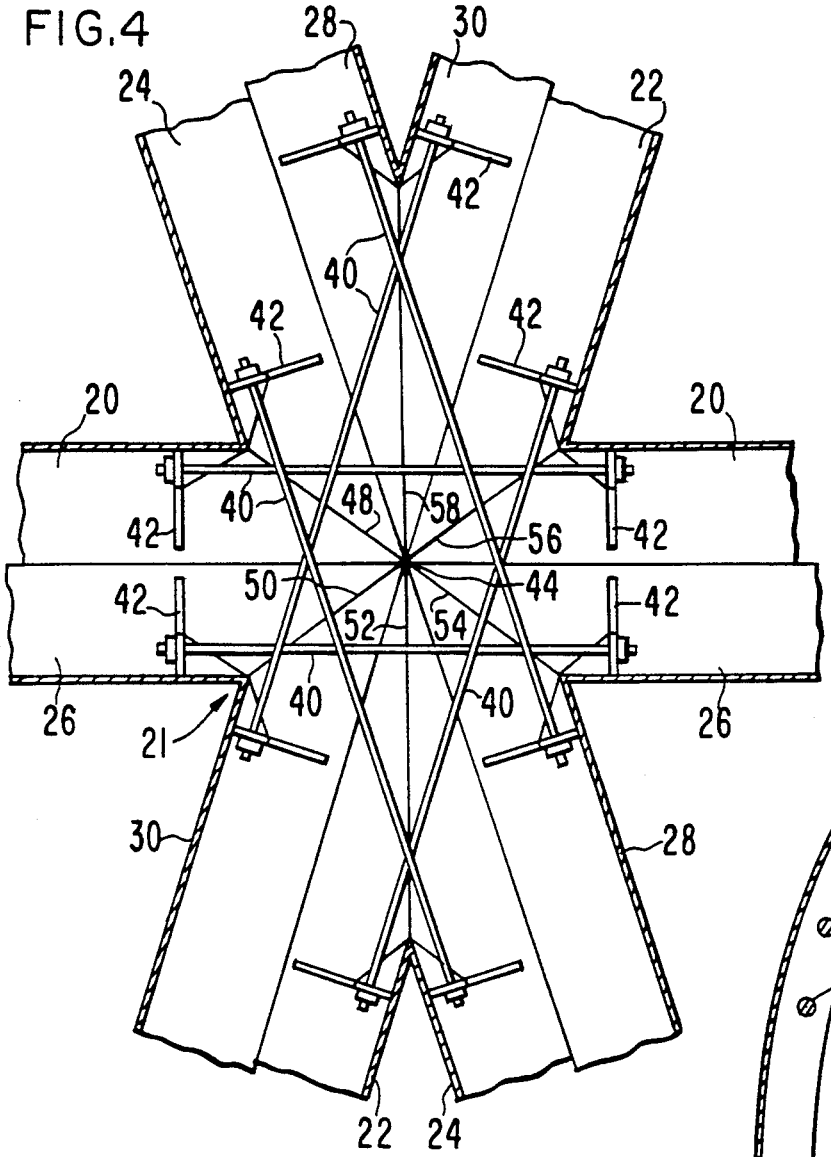
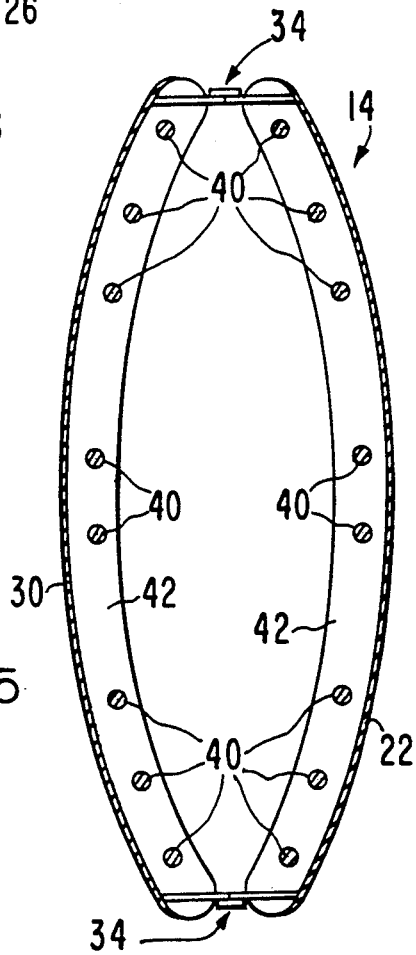
FIG.5

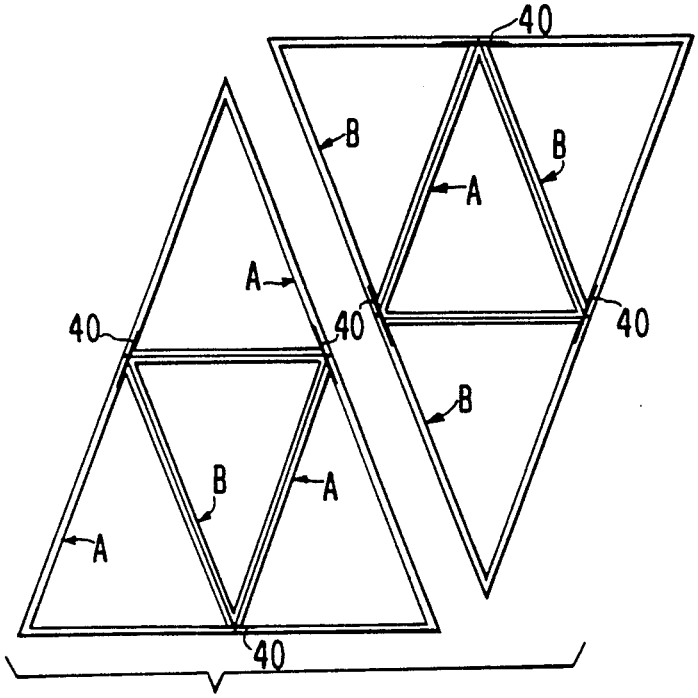
FIG.9
FIG. 10
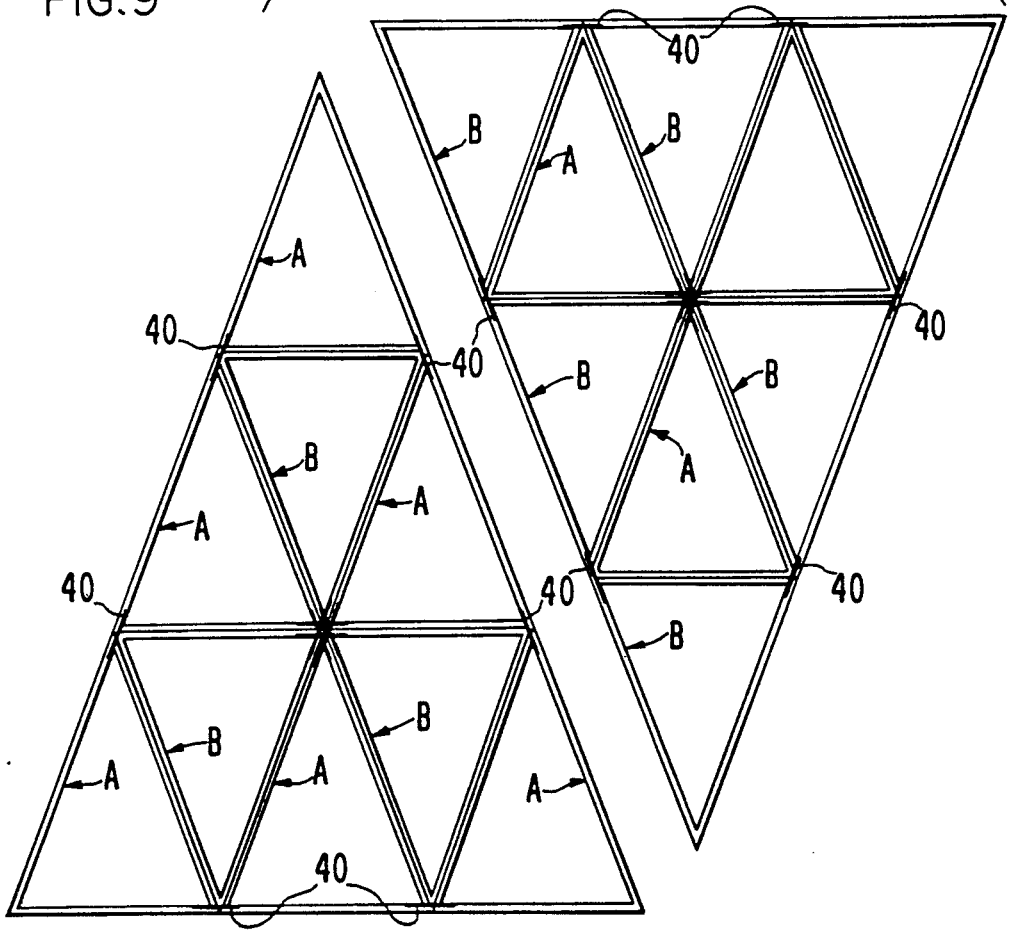

TRIANGULAR COMPOSITE EXOSKELETON STRUCTURE

FIELD OF THE INVENTION

This invention relates to improvements in buildings and, more particularly, to a composite structure forming an exoskeleton or external supportive structure for a building.

BACKGROUND OF THE INVENTION

Triangular structures are used widely in the building industry, mainly for buildings with single-or double-curvature surfaces, such as cylindrical, rotational or spherical surfaces, cylindrical roofs, rotational cooling towers or dome structures. An example of a building having cylindrical and rotational surfaces is the Oakland Coliseum of Oakland, Calif.

Composite structural systems are also known and have been used in the building industry. In such systems, compression chords of trusses advantageously use lighter steel forms and create compression elements by filling the forms with concrete. Composite columns with heavy steel outside forms have also been used to minimize structural steel, heavy lifting, cost of fireproofing and construction time.

Exoskeleton structures have also been known and used in the past. They have been built for cooling towers, water towers and other tower structures. Several of the existing high-rise office buildings in the U.S. also use exoskeleton or outside supporting structures.

Composite space trusses were built and used in Hungary in the period of 1960 to 1970, using the advantages of the composite action of the two materials of light steel and concrete. Horizontal chord members of such trusses were filled with concrete. The prefabricated pyramid elements were produced in large series and were light enough to lift them into final position using heavy equipment. The structural solution and details of these trusses, however, do not solve existing building problems inasmuch as they are not applicable for all supporting exoskeleton structures.

Composite vertical columns using light weight pipes on the external facades of high-rise office buildings have been proposed. Such columns suggested the use of vertical pipes fabricated in two halves. Also, reports have been published on steel-formed pipe columns which have been strengthened by high-strength concrete fill. This use of composite columns results in a rigid architecture. Close rows of heavy circular columns dominate the facades. However, these composite columns do not use the higher lateral rigidity of triangular exoskeleton structure and produce natural architectural forms.

Exoskeleton structures with triangular structural networks are also known in the industry. Domed buildings with exoskeleton structures have been built using triangular half elements with serial fabrication. The bottom row of the triangular elements of such structures start from ground level.

Other exoskeleton structures for towers have also been known; for example, such a structure can be found in the circular tower built for the Port of Kobe, Japan. Other towers, such as hyperbolic cooling towers, use exoskeleton structures. However, neither the domes using triangular exoskeleton structure nor the known tower structures use light steel formings filled with concrete. Such structures use either pure metals or are made with reinforced concrete structures.

Exoskeleton structures have also been proposed for use on buildings with heavy steel structure in box shape or in pipes fabricated from steel plates with thickness up to 80 mm. These suggested structures need heavy lifting equipment and costly and time-consuming site welding procedures done at elevated locations up to 1000 feet above the ground. Most of these structures are expected to be fabricated in faraway places, even in overseas plants; thus, the cost of shipping also increases the cost of erection of the structures.

SUMMARY OF THE INVENTION

The present invention is directed to an exoskeleton structure which is strengthened by concrete and which avoids the drawbacks of conventional structures of this type. The present invention provides an exoskeleton structure made up of a plurality of pairs of triangular frames which are adjacent to each other and which are interconnected to form the exoskeleton structure.

Each triangular frame comprises a basic structural unit having a generally horizontal segment and a pair of upright diagonal segments connected to the respective ends of the respective horizontal segment. The segments of each structural unit are shell-like or curved so that, when they mate with the segments of adjacent triangular units, the segments of the two units form frame elements having hollow interior spaces for receiving concrete which is directed into the hollow spaces after the structural units have been erected.

The configuration of adjacent structural units is repeated throughout the entire extent of the building so that the numerous triangular structural units form an exoskeleton structure having maximum strength and high resistance to lateral forces. The structure suggested by the present invention does not require shipping and lifting of large, heavy structural elements as suggested in the prior art. If heavy lifting equipment is available with the present invention, larger assemblies of structural frame elements can be achieved on the ground to form erectional units which can be lifted together for decreasing the construction effort done at high elevations.

Among the objects, purposes and advantages of the present invention are the following:

To provide an economical structural exoskeleton for unconventional organic architectural forms.

To produce a building structure with high resistance to lateral forces.

To ensure the flexibility of use and modification of an internal building surrounded by the exoskeleton structure of the present invention.

To provide a structural system which can be assembled from relatively large erectional units.

The present invention uses fabricated steel forms which are sufficiently light in weight to lift rigid triangular units or groups of triangular units assembled on the ground without the need for heavy lifting equipment. The mechanical connections between adjacent segments of the triangular units eliminate costly and time-consuming welding on the erected structure. The present invention provides significant savings in structural steel in its fabrication, shipping and erection. These savings in the weight of steel is estimated to be approximately 80%. The concrete fill provides the strength and fire protection for the exoskeleton structure of the present invention. The composite design takes advantage of the bracing and erection bolts to transfer the tension forces at nodes and throughout the structure. Concrete is utilized as connection material between the structural elements and its simple filling procedure provides a substantial savings compared with conventional structural steel connections.

IN THE DRAWINGS

Figure 1:
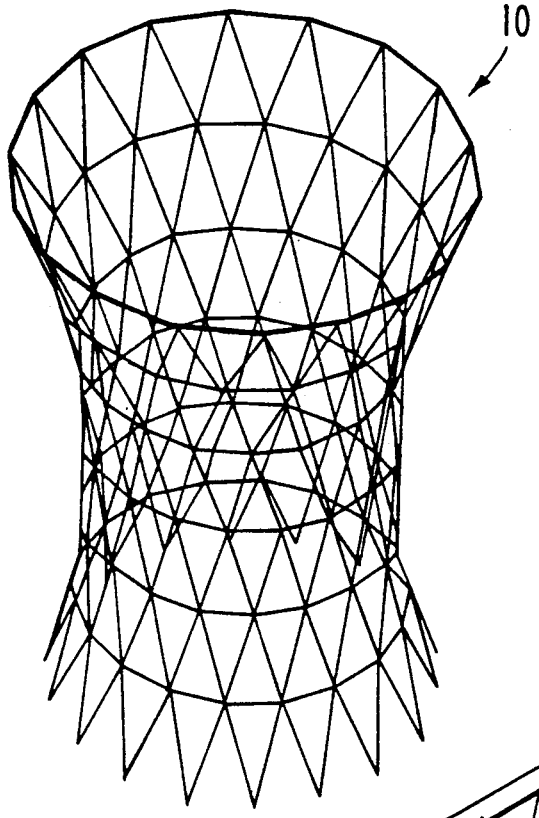
FIG. 1 is a perspective, schematic view of an exoskeleton structure of the present invention with the structure being divided, into a plurality of triangular units and with each triangular unit being defined by a horizontal segment and a pair of inclined segments.
Figure 3:
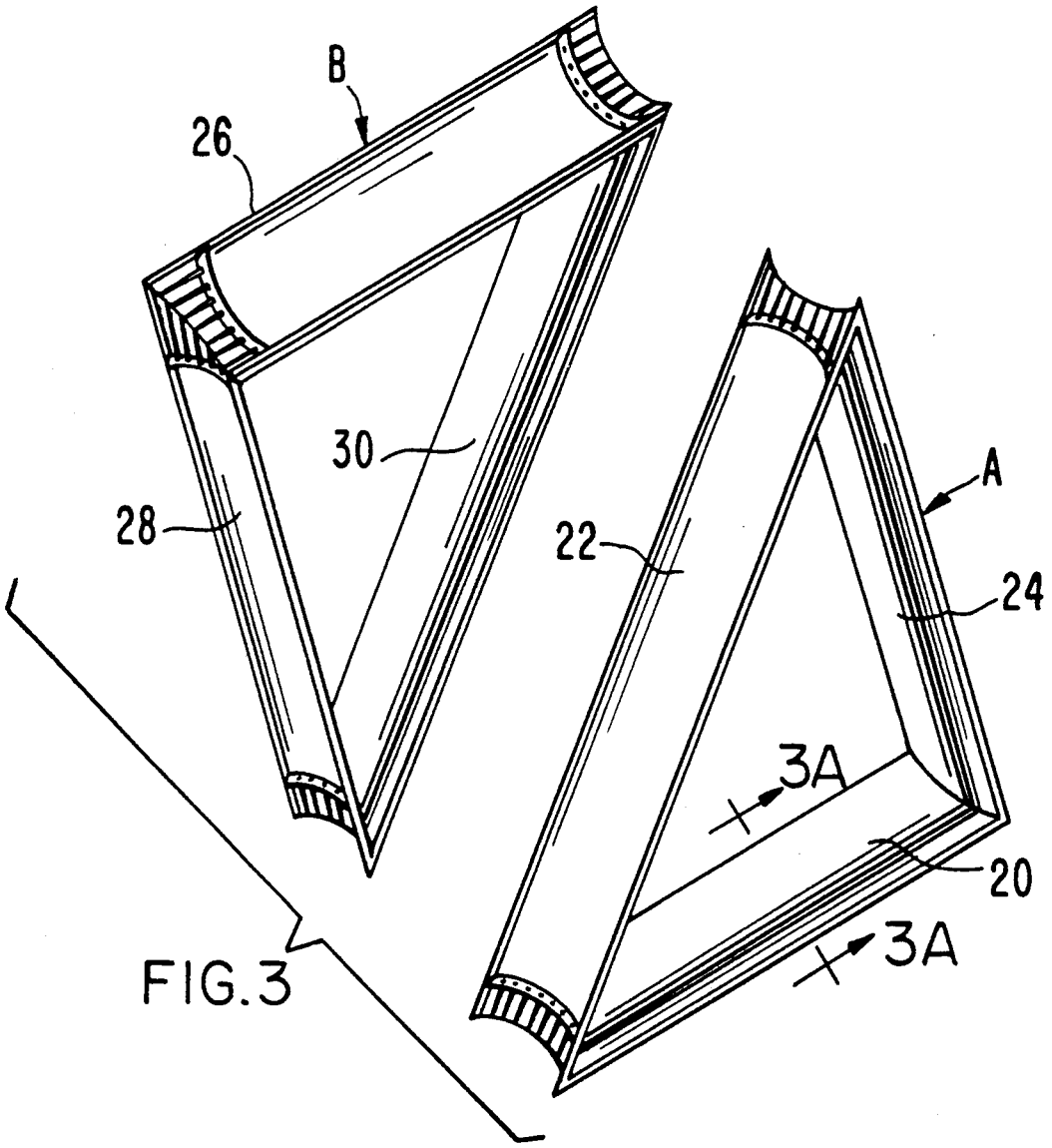
Figure 3A:
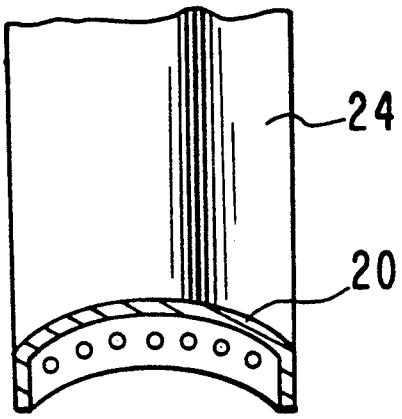
Figure 6:
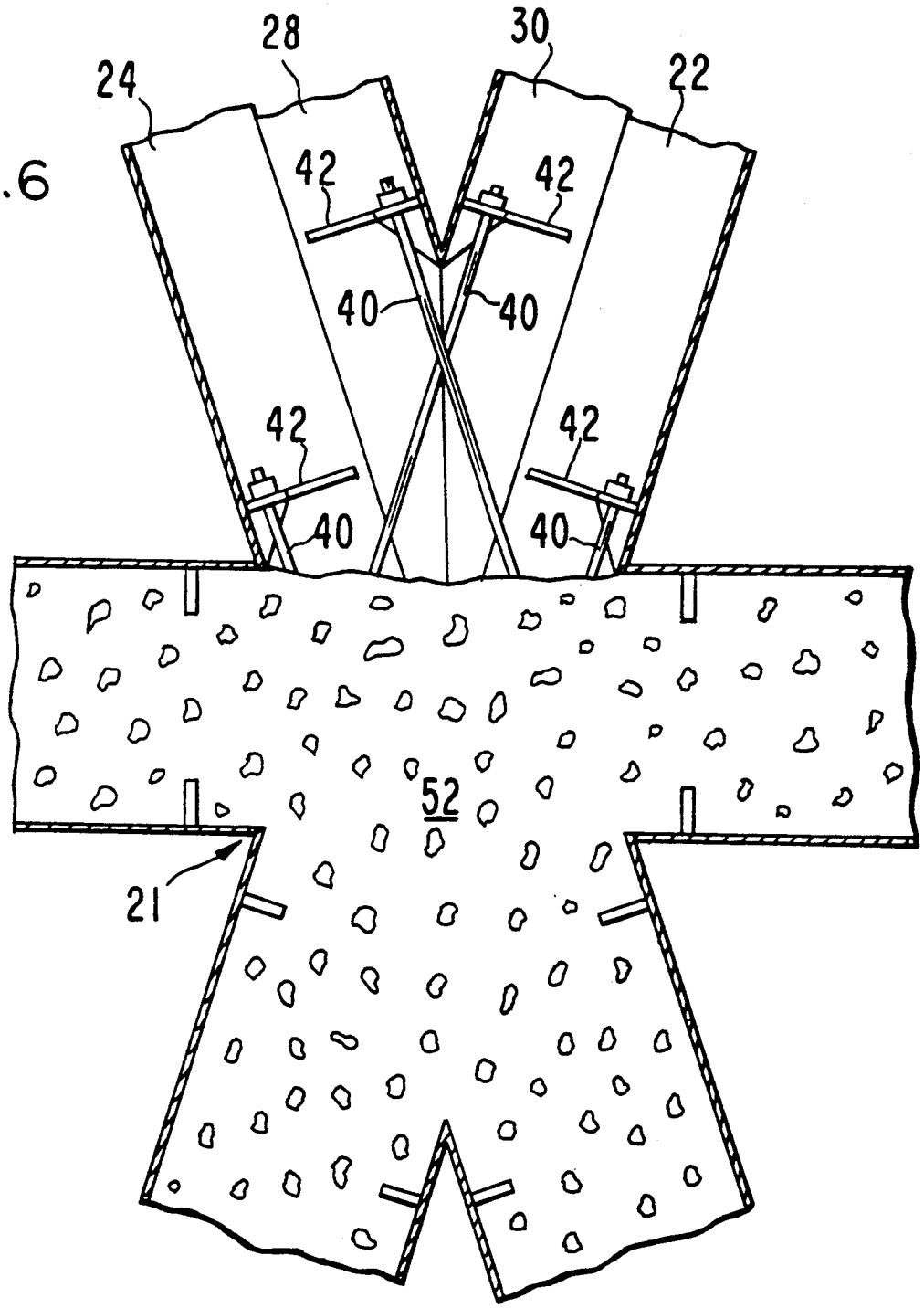
Figure 7:
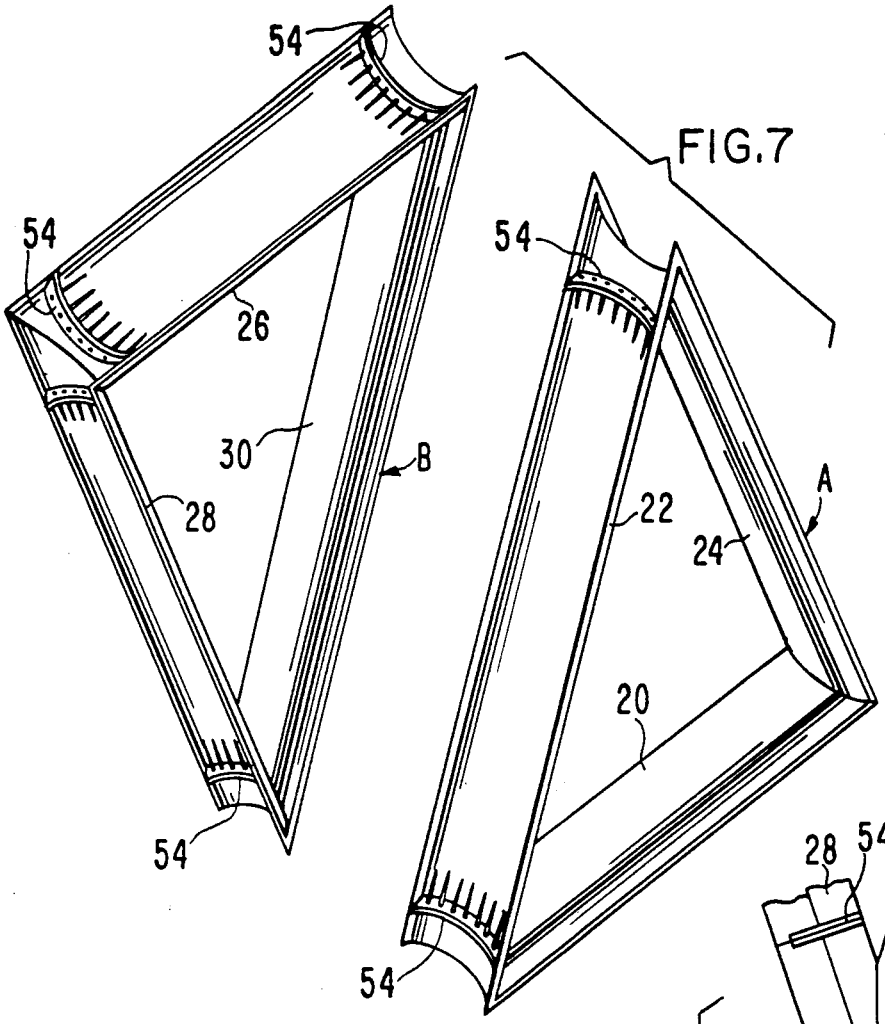
Figure 8:
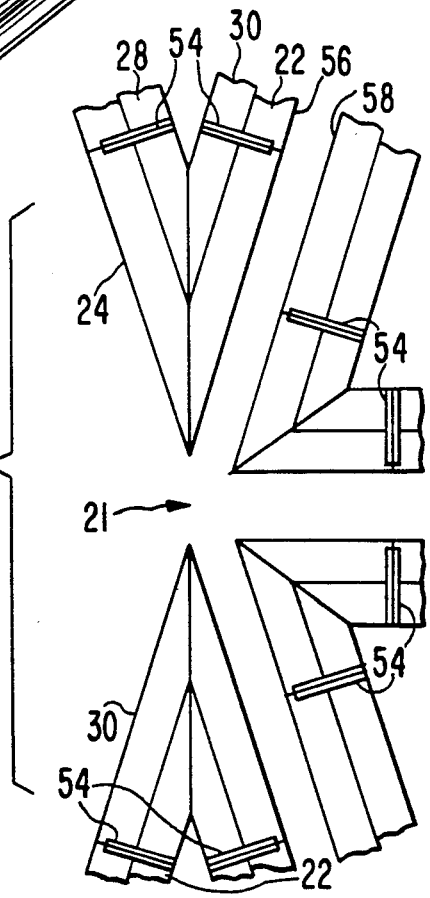
Figure 11:
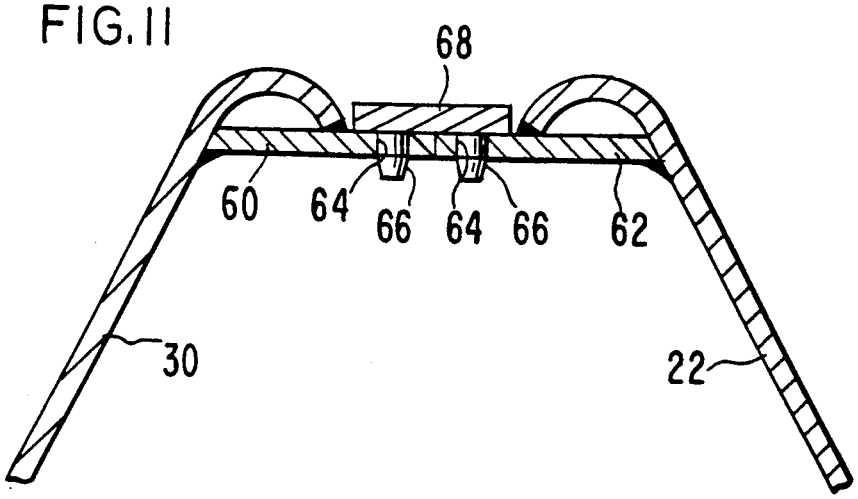

FIG. 3 an enlarged, perspective view of a pair of adjacent triangular units to be coupled together to form the basic erection units of the structure of FIG. 1, the triangular units of FIG. 3 being separated from each other to illustrate details of construction;

FIG. 3A is a cross sectional view taken along line 3A—3A of FIG. 3;

FIG. 4 is an enlarged, fragmentary cross sectional view of a junction or nodal point between a number of triangular units of the exoskeleton structure of the present invention;

FIG. 5 is an enlarged, fragmentary end cross sectional view of a pair of segments of adjacent triangular units joined together at their abutting marginal side edges to form a composite horizontal or an upright structural member forming a part of the structure of FIG. 1;

FIG. 6 is a view similar to FIG. 4 but showing a mass of concrete in the hollow spaces of the triangular units;

FIG. 7 is a view similar to FIG. 3 but showing a pair of triangular units with connecting plates near the ends of the segments thereof;

FIG. 8 is a view similar to FIG. 4 but showing the way in which the shell members fit together at a junction or nodal point;

FIG. 9 is a side elevational view of a pair of adjacent triangular erectional units separated from each other with each unit being comprised of four triangular units coupled together by tension bolts;

FIG. 10 is a view similar to FIG. 9 but showing erectional units made up of nine triangles;

FIG. 11 is an enlarged, fragmentary cross-sectional view of a pair of adjacent segments showing one embodiment of the connecting means for coupling the segments together.

Figure 12:
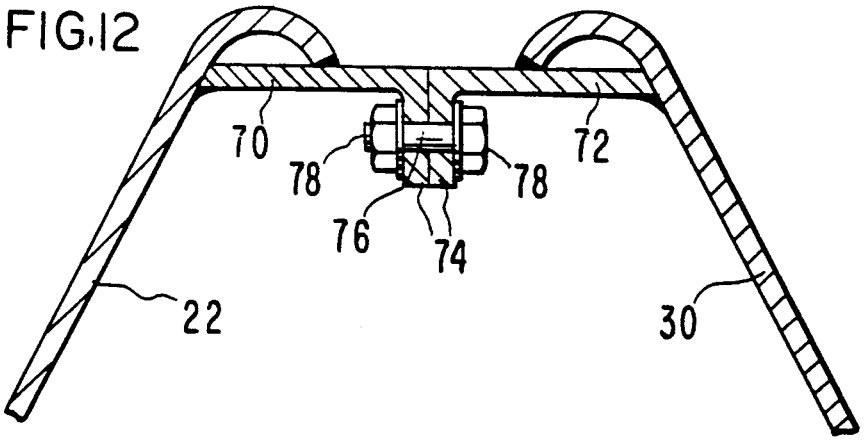
Figure 13:
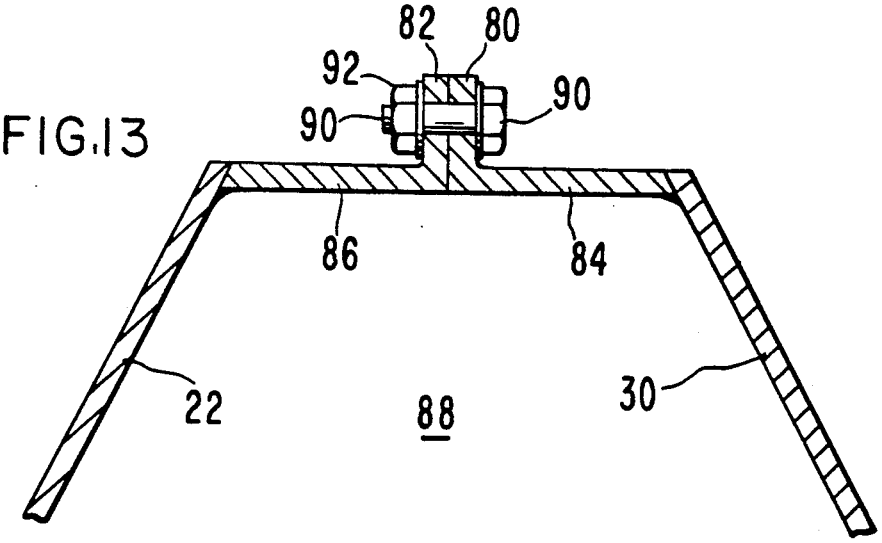

FIG. 12 is a view similar to FIG. 11 but showing another of the connecting means; and FIG. 13 is a view similar to FIGS. 11 and 12 but showing a third embodiment of the connecting means.

DETAILED DESCRIPTION

A triangular exoskeleton structure of the present invention is broadly denoted with numeral 10 and is shown in a specific embodiment in FIG. 1. The structure represents the external, or outside, support matrix or body for a building which is completed within structure 10 after the structure 10 has been erected.

Structure 10 includes a plurality of triangular units throughout the extent of the structure, each triangular unit having a horizontal segment and a pair of inclined, upwardly extending segments. The horizontal segment at one level are parallel with horizontal segments at all other levels of the structure 10 as shown in FIG. 1. The horizontal segments are generally equally spaced apart and extend around the perimeter of structure 10. The inclined segments extend between the levels of the horizontal segments and are connected thereto.

Figure 2:
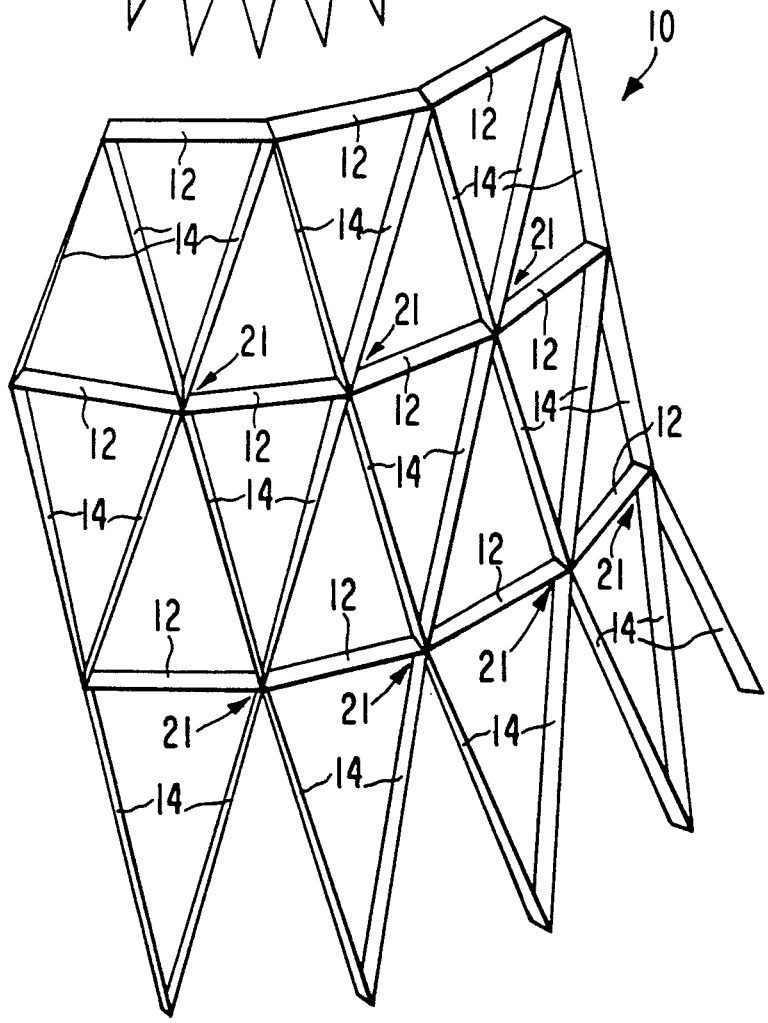
FIG. 2 is an enlarged, fragmentary, perspective view of a portion of the exoskeleton structure of FIG. 1.

FIG. 2 is an enlarged portion of structure 10 and includes triangular units having horizontal frame elements 12 and inclined frame elements 14 connected together repetitively so that structure 10 is made up of a plurality of erectional units which are all triangular in construction.

Each of frame elements 12 and 14 is formed of two elongated, shell-like segments which are coupled together at the side margins thereof as hereinafter described so as to present a hollow space between the segments for receiving concrete. The structure 10 can be made in increments starting with the lower circumferential increment as shown in FIG. 1 and erecting other increments on top of the lower increments previously erected. The concrete can be blown into the hollow spaces at the individual increments as the elements 12 and 14 become connected to the structural portions therebelow.

FIG. 3 shows a pair of adjacent triangular units which form the basic building blocks of the structure 10. A first lower triangular unit is identified by the letter A, and the adjacent triangular unit is denoted by the letter B.

Triangular unit A includes a bottom, transversely curved segment 20 having a cross-section as shown in FIG. 3A. A pair of upright, diagonal, transversely curved segments 22 and 24 are secured at the lower ends thereof to the respective ends of segment 20 and extend upwardly therefrom. The upper ends of segments 22 and 24 are connected together. The connections between the ends of the various segments 20, 22 and 24 are typically made by welding, since these segments are made of metal, such as steel. In each case, the segments 20, 22 and 24 are transversely curved as shown in FIG. 3A.

Triangular unit B has an upper, generally horizontal, transversely curved segment 26 secured at its ends thereof to downwardly extending, transversely curved segments 28 and 30, segments 26, 28 and 30 being coupled together to form a triangular configuration as shown in FIG. 3. Also, each of segments 26, 28 and 30 has a transversely curved cross section as shown in FIG. 3A. Thus, when the two triangular units A and B are joined together, segment 30 will mate with segment 22 so as to form an inclined frame element 14 (FIG. 2), and will also form a hollow space for receiving concrete. Likewise, segment 20 of triangular unit A will mate with a segment 26 of a triangular unit B (not shown) directly below A of FIG. 3 to form a frame element 12 (FIG. 2) and will also form a hollow space for receiving concrete.

Segment 24 of triangular A will mate with segment 28 of a triangular unit B (not shown) to the right of triangular unit A in FIG. 3 to form a frame element 14 (FIG. 2) and also to form a hollow space for receiving concrete. Segment 26 of triangular unit B in FIG. 3 will mate with a segment 30 of a triangular unit A (not shown) above triangular B, and segment 28 of triangular unit B in FIG. 3 will mate with a segment 24 of a triangular unit A (not shown) to the left of triangular unit B in FIG. 3. Thus, the mating of the various segments of adjacent triangular units will form frame elements 12 and 14 and hollow spaces for the reception of concrete, and this series of segments will repeat itself throughout the entire outer peripheral extent of structure 10, regardless of the basic configuration of the structure.

The segments which mate with each other are connected together as shown in FIG. 5 with connector devices 34 at the side margins which extend longitudinally of the segments and connect adjacent segments together, such as segments 22 and 30 of triangular units A and B of FIG. 3. Three different embodiments of the connector device 34 are shown in FIGS. 11–13 hereinafter described.

As shown in FIG. 2, the various segments meet at nodal points 21, and the segments are connected together at nodal points 21 by tension bolts 40 as shown in FIG. 4 which is a vertical section through a nodal point 21. It is clear that for every segment 28, there is a segment 24 adjacent thereto; a segment 30 adjacent to a segment 22; and a segment 20 adjacent to a segment 26, using the format of numbers of FIG. 3. Thus, one-half of the hollow space formed at each nodal point by each pair of adjacent segments is shown in FIG. 4, the walls of the segments being shown as straight lines rather than in section to simplify the drawing.

Bolts 40, as shown in FIG. 4, pass through plates 42 welded to the inner surfaces of adjacent segments, and the plates 42 project into the hollow spaces and form reinforcing means for the concrete which is poured into the space.

There are six types of reinforcing bolts 40 for each nodal point 21 as shown in FIG. 4. Two of the bolts 40 are parallel with each other, are parallel with segments 20 and 26, and are on opposite sides of the midpoint 44 of the nodal point 21. A second pair of parallel bolts 40 are parallel with mating segments 22 and 30, and these bolts are staggered somewhat so as not to interfere with the incoming segments 24 and 28. Similarly, a third pair of parallel bolts 40 is parallel with segments 24 and 28 and is staggered, again to accommodate segments 22 and 30. The bolts effectively connect the segments to which they are coupled, and the bolts are embedded in the concrete once the concrete is poured into the hollow spaces of the mating segments so as to form the dual purpose of connecting respective the segments together as well as providing reinforcing bars for the concrete.

The various segments 20, 22, 24, 26, 28 and 30 are pointed or shaped so that they converge to the single center point 44 of each nodal point 21. Adjacent edges of the converging segments are welded together to further interconnect the segments at nodal point 21. For instance, weld lines can be at lines 48, 50, 52, 54, 56 and 58 (FIG. 4). The tension bolts 40 throughout the completed structure 10 ensure that there is a transition of the tension forces from one pair of mating segments to the next adjacent, continuing pair of mating segments.

FIG. 5 shows a cross sectional view of a frame element 14 (FIG. 2) formed by a pair of mating segments, such as segments 22 and 30. Devices 34 at the side margins of the mating segments interconnect the same.

The hollow interior of the frame elements 12 and 14 formed by pairs of segments is poured with concrete mass 52 (FIG. 6) to form the full, complete composite structure 10, thereby providing the strength and the fire protection of the composite exoskeleton structure 10 as shown in FIG. 6.

An alternate way of fabricating the metallic segments at the corner parts thereof is to provide end plates 54 thereof on the inner surface of the various segments as shown in FIG. 7 and to connect said end plates 54 together by bolt means with the end plates of adjacent segments. Moreover, the double end plates can serve for anchoring tension bolts 40 instead of plates 42 as described above with respect to FIG. 4. FIG. 8 shows the end plates 54 which can be connected by bolts (not shown) at a nodal point 21. Also, the mating side edges, such as edges 56 and 58, can be welded to further strengthen the junction between the various structural elements of the structure 10.

The rigid triangular units A and B may be assembled into erectional units having four triangular units A for every single triangular unit B (FIG. 9A) or erectional units having four triangular units B for every single triangular unit A (FIG. 9B). The erectional units are coupled together by tension bolts 40. The erectional units may be assembled on the ground before lifting into place on structure 10.

FIGS. 10A and 10B show erectional units each having a total of nine triangular units bolted together by tension bolts 40. FIG. 9A shows six triangular units A and three triangular units B. FIG. 10B shows three triangular units A and six triangular units B.

The end connecting devices 34 (FIG. 5) are shown in FIGS. 11–13. The preferred embodiment is shown in FIG. 11 which includes a pair of end plates 60 and 62 welded to the inner surfaces of segments 30 and 22 and spanning the distance between the ends thereof as shown in FIG. 11. The plates have holes 64 therethrough for receiving pins 66 on a plate 68, and the pins 66 are welded or press fitted into holes 64 to interconnect plates 60, 62 and 68 and thereby the adjacent segments.

Device 34 shown in an alternate embodiment in FIG. 12 includes a plate 70 and a plate 72 coupled to segments 22 and 30, respectively; and the plates have end flanges 74 which extend into the space 88 between the segments 22 and 30 and which are coupled together by a bolt 76 and nuts 78.

The embodiment of FIG. 13 is similar to the embodiment of FIG. 12 except that the flanges 80 and 82 on plates 84 and 86 extend outwardly of the space 88 between the two segments 30 and 22. Thus, bolt 90 is outside the space 88 so that nuts 92 can be quickly and easily threaded onto the bolt.

As soon as the exoskeleton structure 10 is erected, concrete is forced into the hollow spaces of the structure, either from the bottom or from the top of the skeleton structure, until the empty spaces are completely filled. Then, a building can be constructed within structure 10.

Structure 10 has a heavier weight than the exoskeleton using hollow steel members, but this effect increases the stability of the structure and decreases the uplift forces of lateral loadings which would need costly foundations.

We claim:

1. An exoskeleton structure comprising:

a body having a plurality of frame elements, each frame element having a pair of opposed ends, adjacent frame elements being connected together at the ends thereof, said frame elements defining a plurality of triangular units and each frame element being hollow, there being a mass of concrete in the frame elements, each frame element including a pair of adjacent, abutting segments, the segments defining each frame element being coupled together and forming the hollow interior of the respective frame element, the segments having inner surfaces, and being shell-like in configuration, and having a pair of abutting, longitudinally extending side margins, there being a connecting device for each side margin, respectively, of each pair of segments, said connecting device for one side margin of the segment including a pair of plates secured to respective segments on the inner surfaces thereof, each plate having a hole therethrough, a second connecting plate, and a pair of pins connected to the second plate and extending into the holes in the first plates.

2. A structure as set forth in claim 1, wherein said pins are press-fitted into the holes.

3. A structure as set forth in claim 1 wherein said pins are welded to the first plates and extend through said holes.

4. A structure as set forth in claim 2, wherein said connecting device includes a pair of flanged plates secured to the inner surfaces of respective segments, the flanges of the plates being in face-to-face relationship to each other, and bolt means interconnecting the flanges.

5. A structure as set forth in claim 4, wherein said flanges extend into the hollow space of the segments.

6. A structure as set forth in claim 4, wherein the flanges extend outwardly from the segments.

7. An exoskeleton structure comprising:

a body having a plurality of frame elements, each frame element having a pair of opposed ends, adjacent frame elements being connected together at the ends thereof, said frame elements defining a plurality of triangular units and each frame element being hollow, there being a mass of concrete in the frame elements, the body having a plurality of nodal points, a number of frame elements being convergent toward each other at each of said nodal points, and bolt means interconnecting the adjacent frame elements at each nodal point, respectively, a pair of frame elements being on opposed sides of a respective nodal point, said pair of frame elements extending outwardly from the nodal point in opposite directions, said bolt means including an elongated bolt passing through the vicinity of the nodal point, and means connecting the ends of the bolt to the inner surfaces of the adjacent frame elements.

8. A structure as set forth in claim 7, wherein is included a second bolt parallel with the first bolt, said pair of bolts being on opposite sides of the nodal point, and means connecting the ends of the second bolt to the inner surfaces of the adjacent frame elements.

9. A structure as set forth in claim 7, wherein said connecting means includes a plate for each end, respectively, of the bolt, each plate being secured to the inner surface of a respective frame element and having a hole therethrough, said bolt extending through the hole of the plate, and nut means for anchoring the bolt to the plate.

10. An exoskeleton structure comprising:

a body having a plurality of frame members, each frame element having a pair of opposed ends, adjacent frame elements being connected together at the ends thereof, said frame elements defining a plurality of triangular units and each frame element being hollow, there being a mass of concrete in the tubular elements, said body having a plurality of nodal points, there being a pair of horizontal frame elements converging toward each nodal point, respectively, a pair of upper diagonal frame elements converging toward said nodal point, respectively, and a pair of lower diagonal frame elements converging toward the nodal point, respectively, and means connecting horizontal, upper and lower frame elements together at the respective nodal point, said connecting means including a plurality of weld lines connecting the horizontal frame elements to the diagonal frame elements, said connecting means including bolt means extending through the vicinity of the nodal point for connecting the horizontal frame elements together, for connecting a first upper frame element to a first lower frame element, and for connecting a second upper frame element to a second lower frame element, said bolt means including a first pair of parallel bolts interconnecting the horizontal frame elements, a second pair of bolts for interconnecting said one upper frame element with said one lower frame element, and a third pair of bolts interconnecting the second upper frame element with the second lower frame element.

11. A structure as set forth in claim 10, wherein is included a pair of anchor plates for each bolt, respectively, the anchor plates being coupled rigidly to the inner surfaces of respective frame elements and each plate having a hole therethrough for receiving the adjacent end of the respective bolt, and nut means threadably mounted on the end of the bolt for coupling the bolt to the plate.

12. An exoskeleton structure comprising:

a body having a plurality of frame members, each frame element having a pair of opposed ends, adjacent frame elements being connected together at the ends thereof, said frame elements defining a plurality of triangular units and each frame element being hollow, said body adapted to receive a mass of concrete in the tubular elements, the body having a plurality of nodal points, a number of frame elements being convergent toward each other at each of said nodal points, and bolt means interconnecting the adjacent frame elements at each nodal point, respectively, and a pair of frame elements on opposed sides of a respective nodal point, said pair of frame elements extending outwardly from the nodal point in opposite directions, said bolt means including an elongated bolt passing through the vicinity of the nodal point, and means connecting the ends of the bolt to the inner surfaces of the adjacent frame elements.

13. A structure as set forth in claim 12, wherein is included a second bolt parallel with the first bolt, said pair of bolts being on opposite sides of the nodal point, and means connecting the ends of the second bolt to the inner surfaces of the adjacent frame elements.

14. A structure as set forth in claim 12, wherein said connecting means includes a plate for each end, respectively, of the bolt, each plate being secured to the inner surface of a respective frame element and having a hole therethrough, said bolt extending through the hole of the plate, and nut means for anchoring the bolt to the plate.

15. An exoskeleton structure comprising:

a body having a plurality of frame members, each frame element having a pair of opposed ends, adjacent frame elements being connected together at the ends thereof, said frame elements defining a plurality of triangular units and each frame element being hollow, said body adapted to receive a mass of concrete in the tubular elements, said body having a plurality of nodal points, there being a pair of horizontal frame elements converging toward each nodal point, respectively, a pair of upper diagonal frame elements converging toward said nodal point, respectively, and a pair of lower diagonal frame elements converging toward the nodal point, respectively, and means connecting horizontal, upper and lower frame elements together at the respective nodal point, said connecting means includes bolt means extending through the vicinity of the nodal point for connecting the horizontal frame elements together, for connecting a first upper frame element to a first lower frame element, and for connecting a second upper frame element to a second lower frame element.

16. A structure as set forth in claim 15, wherein said bolt means includes a pair of parallel bolts interconnecting the horizontal frame elements, a second pair of bolts for interconnecting said one upper frame element with said one lower frame element, and a third pair of bolts interconnecting the second upper frame element with the second lower frame element.

17. A structure as set forth in claim 16, wherein is included a pair of anchor plates for each bolt, respectively, the anchor plates being coupled rigidly to the inner surfaces of respective frame elements and each plate having a hole therethrough for receiving the adjacent end of the respective bolt, and nut means threadably mounted on the end of the bolt for coupling the bolt to the plate.

* * * * *